US008512191B2

(12) United States Patent
Xie et al.

(10) Patent No.: US 8,512,191 B2
(45) Date of Patent: Aug. 20, 2013

(54) VARIABLE SPEED CONTROL DEVICE OF A POWER WINCH

(76) Inventors: Yuzhi Xie, Zhejiang (CN); Kuo-hsiang Tsao, Zhejiang (CN)

( * ) Notice: Subject to any disclaimer, the term of this patent is extended or adjusted under 35 U.S.C. 154(b) by 394 days.

(21) Appl. No.: 12/991,795

(22) PCT Filed: Oct. 21, 2008

(86) PCT No.: PCT/CN2008/072773

§ 371 (c)(1),
(2), (4) Date: Nov. 9, 2010

(87) PCT Pub. No.: WO2009/152666

PCT Pub. Date: Dec. 23, 2009

(65) Prior Publication Data

US 2011/0065546 A1 Mar. 17, 2011

(30) Foreign Application Priority Data

Jun. 18, 2008 (CN) ..... 2008 1 0062600

(51) Int. Cl.
*F16H 48/06* (2006.01)

(52) U.S. Cl.
USPC ..... 475/149

(58) Field of Classification Search
None
See application file for complete search history.

(56) References Cited

U.S. PATENT DOCUMENTS

2003/0125150 A1* 7/2003 Tanzer ..... 475/150

FOREIGN PATENT DOCUMENTS

| | | |
|---|---|---|
| CN | 2034965 | 3/1989 |
| CN | 2654581 | 11/2004 |
| CN | 2672017 Y | 1/2005 |
| CN | 101062753 | 10/2007 |
| CN | 200971295 | 11/2007 |
| CN | 101332965 | 12/2008 |
| GB | 1148995 | 4/1968 |
| JP | 7206384 | 8/1995 |

* cited by examiner

*Primary Examiner* — Erin D Bishop
(74) *Attorney, Agent, or Firm* — Dickinson Wright PLLC

(57) ABSTRACT

A variable speed control device of a power winch includes a low-speed transmission mechanism and a high-speed transmission mechanism, and a clutch mechanism is fastened to a gear box for switching between the high-speed transmission mechanism and the low-speed transmission mechanism; the high-speed transmission mechanism includes a shifting gear (16) arranged at a top of the gear box (14) and driven by a controller; said shifting gear is connected to a connecting rod positioned in an axle hole of the gear box; the low-speed transmission mechanism is a planetary gear mechanism.

10 Claims, 4 Drawing Sheets

VARIABLE SPEED CONTROL DEVICE OF A POWER WINCH

CROSS-REFERENCE TO RELATED APPLICATIONS

This application is a National Stage of International Application No. PCT/CN2008/072773, filed Oct. 21, 2008. This application claims the benefit and priority of Chinese Patent Application 200810062600.5, filed Jun. 18, 2008. The subject invention relates to a speed control device of a power winch for drawing construction machinery or transportation machinery, in particular, to a variable speed control device of a power winch.

BACKGROUND OF THE INVENTION

1. Field of the Invention

The subject invention relates to a speed control device of a power winch for drawing construction machinery or transportation machinery, in particular, to a variable speed control device of a power winch.

2. Prior Art

A power winch is a lifting machinery for lifting an object via reeling tight wire rope, and widely used in applications of engineering construction, heavy objects' transportation, and self-aid and buddy aid in case of accidents. To meet the requirement of the operator, it is common to use a dual speed winch to release the wire rope quickly and hook the object, and to operate at a lower speed to ensure the loading security when lifting the object. Some of the prior art dual speed winches are fully mechanical, such as "Dual Speed Winch" of CN2672017Y. The technical solution disclosed by CN2672017Y is that a hand-operated belt brake or an electro-hydraulic shoe brake is used as the primary brake, a hand-operated belt brake is used as the secondary brake, and a bevel gear with curved teeth and an involute cylindrical gear are used as the gear mechanism. Another example is "A Dual Speed Winch Including a Planetary Transmission Mechanism" of CN101062753A, which discloses a technical solution comprising an electrical motor, a gear box, a planetary transmission mechanism, and brakes, etc. The planetary transmission mechanism includes a high-speed planetary transmission mechanism and a low-speed planetary transmission mechanism with different speed ratio. The high-speed planetary pinion carrier of the high-speed planetary transmission mechanism is connected to a high-speed brake, and the low-speed planetary pinion carrier of the low-speed planetary transmission mechanism is connected to a low-speed planetary transmission output shaft, and then to a low-speed brake. Generally, fully mechanical dual speed winches have the properties of, e.g., high load capacity and smooth transmission. However, the former dual speed winch is controlled by the primary brake and the secondary brake, and the latter is controlled by the high-speed brake and the low-speed brake. Accordingly, both of them use two controllers to perform respective control. They have complicated mechanism, which increases the cost of manufacture, and they are difficult to operate, which reduces their security.

SUMMARY OF THE INVENTION

The object of the invention is to overcome the defects of the prior art and provide a variable speed control device of a power winch with simple structure, easy operation, and high security.

According to the above object, the invention is realized by the following technical solution:

A variable speed control device of a power winch, includes a power-driven input shaft with a gear segment, a gear box positioned at the power winch, a transmission seat surrounding the input shaft within the gear box, the transmission seat being connected to a wire rope roll drum of the power winch and supported by a bearing, so as to realize a low-speed transmission mechanism with low-speed output and a high-speed transmission mechanism with high-speed output of the transmission seat, and a controller controlling the low-speed output and the high-speed output; the low-speed transmission mechanism is a planetary gear mechanism, characterized in:

a. said high-speed transmission mechanism includes a shifting gear which is arranged at a top of the gear box and driven by the controller; said shifting gear and a connecting rod positioned in an axle hole of the gear box are transmission connected; a lower end of the connecting rod extends downward and forms an eccentric axis inserted in and connected to a ring groove of a transmission shaft; the transmission shaft is mounted coaxially with and makes axial displacement with respect to the input shaft; a clutch gear is mounted on the transmission shaft and supported by a bearing, and has a structure of both internal and external teeth and engages the gear segment of the input shaft and internal teeth of the transmission seat to output a high rotational speed;

b. said controller is a clutch mechanism fastened to the gear box and switches among the low-speed transmission mechanism, the high-speed transmission mechanism, and neutral without output, shares and is controlled by said clutch mechanism.

Said planetary gear mechanism for low-speed transmission includes a plurality of planetary gears engaging the gear segment of the input shaft, each of planetary gears is mounted on the transmission seat via a planet pin and drives the transmission seat to make low-speed rotation. A ring gear surrounds and engages the planetary gears, and braking recesses are disposed on the outer circumferential surface of the ring gear and can be inserted by a clutch lever of the clutch mechanism. Said positioning of said connecting rod in the axle hole of the gear box is a supporting screw or positioning pin connected to the gear box and inserted into a ring groove of the connecting rod.

The transmission seat has a bushing on an interface between the transmission seat and the gear box, and a gasket on a connection end surface between the transmission seat and the ring gear.

Retaining rings are disposed at two sides of the bearing between the transmission shaft and the clutch gear, respectively.

Said plurality of planetary gears range from 2 to 4, and an equal number of mounting holes for planet pins are arranged on the transmission seat correspondingly.

Multi-roll bearings are disposed between said planetary gears and said planet pins.

There are 2-4 braking recesses on the ring gear.

Said clutch mechanism includes a clutch plate with an external gear, and said external gear of said clutch plate and said shifting gear have the same module and the same number of teeth.

A clutch handle of said clutch mechanism is embedded in the clutch plate, said clutch handle is connected to the clutch lever via a pin, and said pin operatably passes through a long-slotted hole arranged in a perpendicular direction on the clutch plate.

As compared with the prior art, the power winch of the invention has not only low-speed transmission output and high-speed transmission output, but also a function of neutral without output. In addition, the three outputs share one controlling clutch mechanism. This greatly simplifies the entire structure. The structure of both the low-speed transmission mechanism with low-speed output and the high-speed transmission mechanism with high-speed output is simple, which greatly reduces the manufacture cost of the entire winch. Because low-speed output, high-speed output, and neutral without output are switched by only one clutch mechanism, easy operation and improved security are achieved.

DETAILED DESCRIPTION OF THE INVENTION

Figure 1:
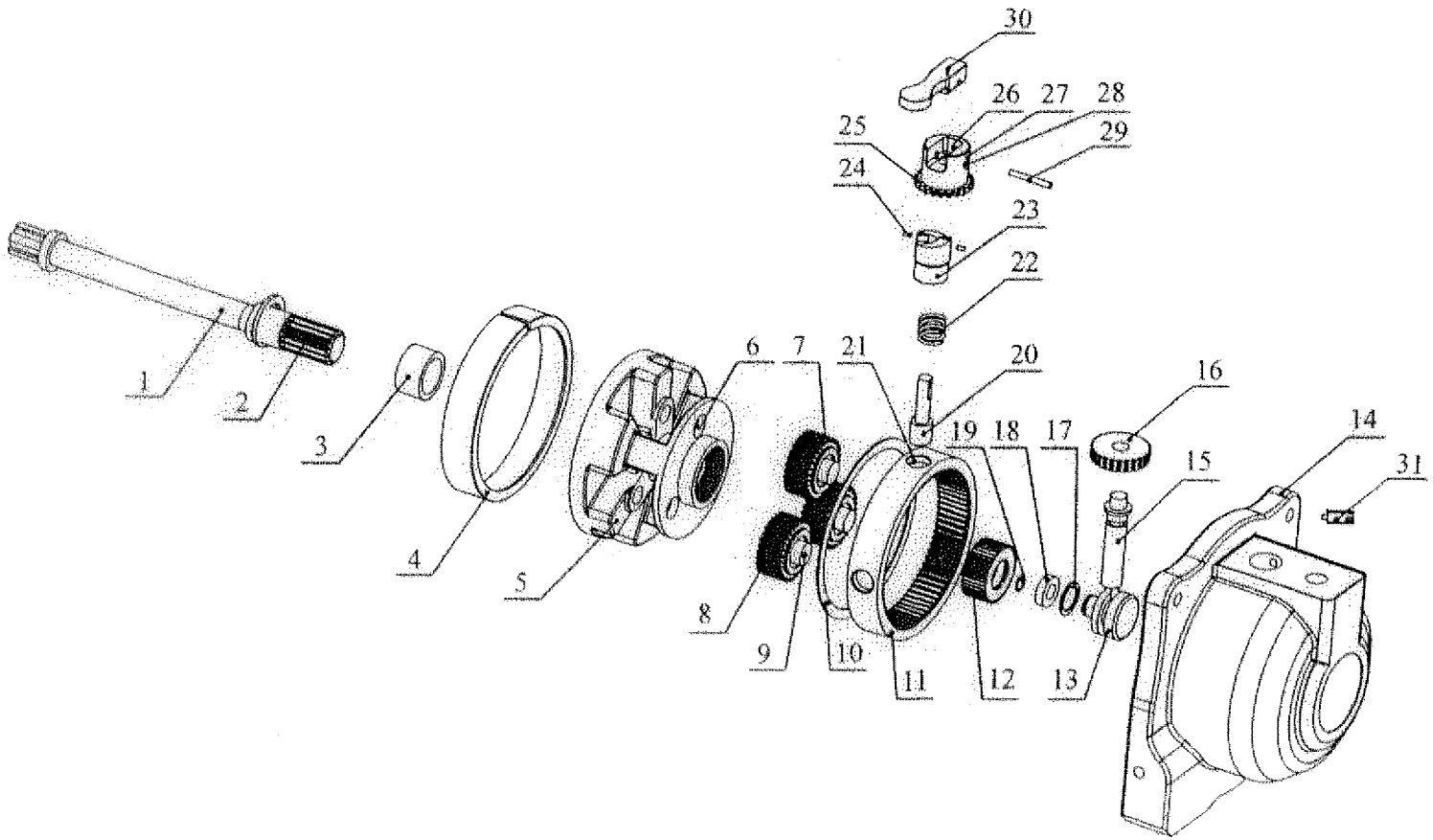
FIG. 1 is an exploded structural schematic view of the invention.

An embodiment of the invention will be further described in detail in connection with the appended drawings.

As shown in FIGS. 1-4, each of the reference numerals refers to: input shaft; gear segment; multi-roll bearing; bushing; transmission seat; mounting holes; planetary gear; multi-roll bearing; planet pins; gasket; ring gear; clutch gear; transmission shaft; gear box; connecting rod; shifting gear; retaining ring; bearing; retaining ring; clutch lever; braking recesses; spring; clutch sleeve; spring pins; external gear; recess; clutch plate; long-slotted hole; pin; clutch handle; supporting screw or positioning pin.

The variable speed control device of a power winch according to the invention includes a power-driven or hydraulic driven input shaft 1 with a gear segment 2. The gear segment 2 has a chamfered end and extends through the axle hole of a transmission seat 5, and is supported by a multi-roll bearing 3. The transmission seat 5 is disposed in the axle hole of a gear box 14 and has an internal end with internal gear structure. It is connected to a wire rope roll drum of the power winch and outputs power. In order to inhibit the wear of the rotating face of the transmission seat, a bushing 4 of a wear resistant material is adhered to the inside of the axle hole of the gear box 14.

A low-speed transmission mechanism outputting a low speed and a high-speed transmission mechanism outputting a high speed are disposed in the gear box 14. The low-speed transmission mechanism is a planetary gear mechanism, which is disposed in three equally divided recesses on the transmission seat 5 and includes planetary gears 7 circumferentially equally divided into three groups and engaging the gear segment 2 of the input shaft 1. Planet pins 9 of the planetary gears are mounted in an equal number of mounting holes 6 at the transmission seat 5 so as to drive the transmission seat 5 to make low-speed rotation. In addition, to make the rotation more agile, a multi-roll bearing 8 is disposed between each group of the planetary gear and the planet pin. A ring gear 11 is arranged at the inner side of the gear box 14 and engages the three planetary gears 7. Four braking recesses 21 are uniformly distributed on the outer circumferential surface of the ring gear, and are switched and controlled by a controller. A gasket 10 of a wear resistant material is disposed on the dynamic jointing surface between the ring gear and the transmission seat and adhered to one side of the ring gear 11. When a certain braking recess of the ring gear is locked by a brake controller, besides rotation, the three planetary gears revolve in the ring gear, such that the transmission seat is driven to rotate and outputs a low-speed power; when the controller gives up its lock of the ring gear, the ring gear runs idle, and thus the three planetary gears rotate only and are unable to drive the transmission seat to rotate and output the power.

The high-speed transmission mechanism is a gear transmission mechanism including a shifting gear 16 which is arranged at the top of the gear box 14, switched, controlled, and driven by the controller. The shifting gear and a connecting rod 15 disposed in the axle hole of the gear box establish their transmission relationship via a square tenon or spline. To prevent the detachment of the connecting rod from the gear box, the connecting rod and the gear box have to be positioned and connected. A specific solution is to machine a ring groove at the connecting rod, and dispose a supporting screw or positioning pin 31 at the gear box which is snapped into the ring groove of the connecting rod. A lower end of the connecting rod 15 extends downward and forms an eccentric axis inserted in and connected to the ring groove of the transmission shaft 13. When the connecting rod is driven to rotate, the eccentric axis allows the transmission shaft to have a force for an axial displacement along the inner groove of the gear box. Because the transmission shaft and the input shaft are mounted coaxially, push a clutch gear 12 mounted on the transmission shaft and supported by a bearing 18 to the gear segment 2 of the input shaft and make them engage one another. And because the clutch gear has a structure of both internal and external teeth, when the clutch gear is pushed and engages the input shaft, an engaging length of 6 mm is enough. At the same time, the external teeth of the clutch gear engage internal teeth of the transmission seat 5. At that time, since the controller has given up its lock of the ring gear 11, a power is input by the clutch gear 12 and the transmission seat 5 has a high-speed output. Retaining rings 17, 19 are disposed at both sides of the bearing 18 on the transmission shaft 13 and serve as positioning inner and outer rings.

The controller switching the low-speed output and high-speed output uses the technical solution of a clutch mechanism according to a previous application of the applicants, which has an application number of 200620106776.2 and a title of "Clutch Device for Electric Winches", and some improvement is made to the clutch mechanism. It includes a braking port with a threaded hole disposed on the gear box corresponding to the braking recesses 21 of the ring gear 11. A clutch sleeve 23 with outer screw thread is screwed into the threaded hole of the braking port, and fastened by a tightened screw (not shown) in a side screw hole so as to achieve an object of the detachable fixed connection. The top surface of the clutch sleeve 23 is a cam face formed by the double tapered faces, and a pair of pin holes is symmetrically arranged at the radial sides of the top portion of the clutch sleeve to tightly engage spring pins 24. The outer ends of the spring pins 24 are extended outward 1 mm from the hole.

The inner hole of the clutch sleeve 23 has a step structure and a clutch lever 20 with a reversed T-shaped cross section is disposed in the hole. The clutch lever 20 can be embedded in the braking recesses 21 of the ring gear, and is surrounded by an elastic element, such as a pressed spring 22, A clutch plate 27 surrounds the upper portion of the clutch sleeve. The inner top surface of the clutch plate and the up top surface of the clutch sleeve are engaged cam faces formed by the double tapered faces, respectively. The clutch lever 20 is driven to lift or drop by rotating a clutch handle 30 clockwise or anticlockwise, so as to be engaged or disengaged with the braking recesses 21 of the ring gear 11. Four flanges are circumferentially uniformly distributed on an inner circumferential surface of the clutch plate 27, wherein two diagonal flanges are short flanges which are arranged on the top surface of the inner circumferential surface of the clutch plate, extend downward, and have a length of 5 mm, while the other two diagonal flanges are long flanges which are arranged on the inner top surface to the bottom. The four flanges constitute a circle surrounding the outer circumference of the clutch sleeve 23.

In the meanwhile, an angular rotation positioning mechanism is arranged between the clutch plate 27 and the clutch sleeve 23. In theory, the mechanism should be called 180-degree rotation positioning mechanism. The rotation positioning mechanism includes the spring pins 24 at the diametrically opposite sides of the top portion of the clutch sleeve in combination with the diagonal long flanges on the inner circumferential surface of the clutch plate 27. While the clutch plate is rotating, the two spring pins 24 of the clutch sleeve become in contact with the two long flanges of the clutch plate 27 and thus get positioned.

Figure 2:
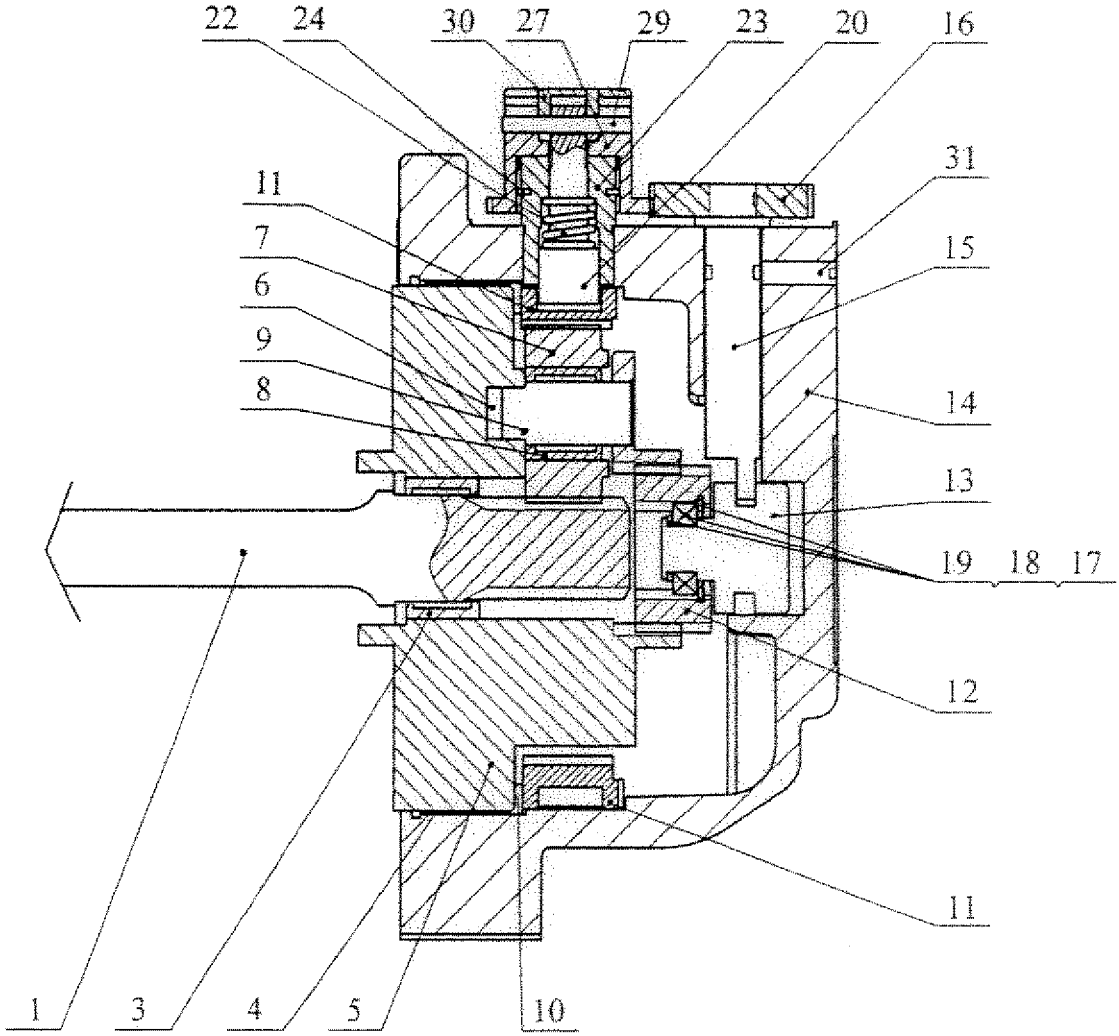
FIG. 2 is a structural schematic sectional view of the invention in the state of low-speed output.
Figure 3:
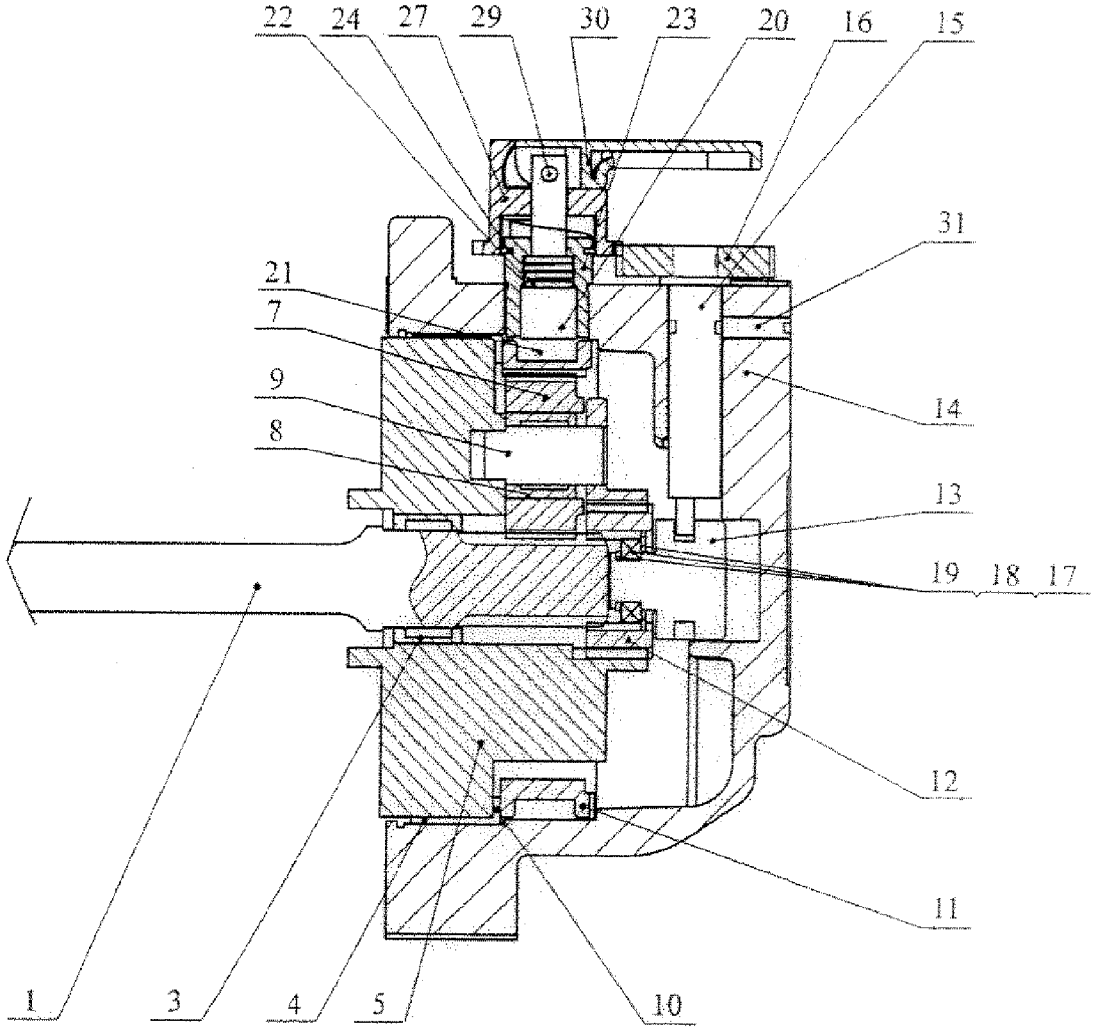
FIG. 3 is a structural schematic sectional view of the invention in the state of high-speed output.

When the clutch handle 30 is rotated anticlockwise until the spring pins 24 of the clutch sleeve 23 contact the other long flange of the clutch plate 27, the difference between the two inclines of the cam faces which is formed by the double tapered faces on the up top surface of the clutch sleeve and the inner top surface of the clutch plate changes from lower to higher so as to prompt the clutch lever 20 to lift and be disengaged from the braking recesses 21 of the ring gear, and thus realize the function of disengagement of the clutch mechanism, and be positioned by a positioning structure consisting of the spring pin on the clutch sleeve and the diagonal long flanges on the inner circumferential surface of the clutch plate. When the wire rope is pulled out in the disengaging state, the ring gear 11 associated with the low-speed transmission mechanism run idle at its original place. At the same time, the clutch plate 27 is driven to ascent, and constant speed drive is performed because the external gear 25 on the clutch plate and the shifting gear 16 engage one another with the same module and the same number of teeth, which is an improvement to the original clutch mechanism. And the mechanism is switched to a high-speed transmission state, as shown in FIG. 3. Now the wire rope can be pulled out quickly and easily to hook and drag an object. Otherwise, when the clutch plate 27 and the clutch handle 30 are rotated 180 degrees clockwise, the difference between the inclines is changed from higher position to lower so as to prompt the clutch lever 20 to be engaged with the braking recesses 21 of the ring gear again, and thus realize the function of engagement of the clutch mechanism. The mechanism is switched to a low-speed transmission state, as shown in FIG. 2. Similarly, it is positioned by a positioning structure consisting of the spring pin and the diagonal long flanges. The power of the gear mechanism can be transmitted to the wire rope roll drum via the transmission seat 5. Accordingly, when the electrical motor runs, the wire rope can be retracted by the power so as to hook an object.

Figure 4:
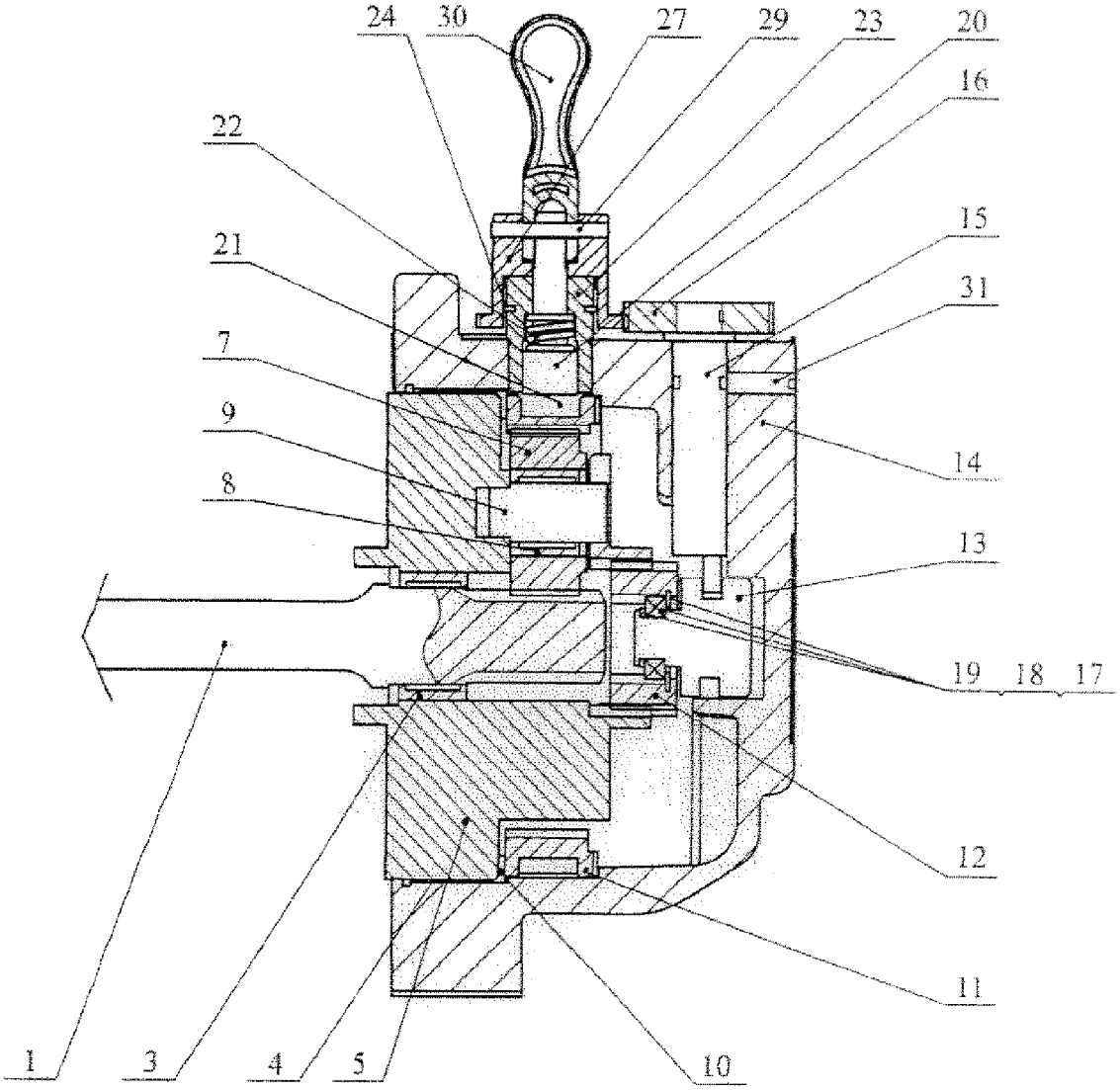
FIG. 4 is a structural schematic sectional view of the invention in neutral and without output.

When the mechanism needs maintenance, it is required that the mechanism be in the state of neutral and having no output, as shown in FIG. 4. The mechanism has to be in the state of low-speed transmission first. And then it can be switched to the state of neutral and having no output. At that time, the clutch handle 30 needs to be turned upward to a perpendicular condition. The clutch handle 30 is mounted in a top surface recess 26 of the clutch plate 27. As shown in FIG. 1, one side of the recess is open and the other is not. The clutch handle is connected to the clutch lever 20 via a pin 29. The pin passes through a long-slotted hole 28 arranged in a perpendicular direction on the clutch plate 27, as shown in FIG. 1. At that time, the clutch plate has no ascending action (only when the clutch handle is turned anticlockwise or clockwise, an ascending or descending displacement is possible because of the cam faces). Since the pinhole of the clutch handle 30 connecting the pin 29 is at an eccentric position, i.e., the distance between the pinhole and the lowest edge of the clutch handle is less than that between the pinhole and the side end of the clutch handle, and since the lower portion of the side end is round-corner-shaped, when the clutch handle is turned upward, the round-corner-shaped side end turns for 90 degrees and thus the clutch handle is pressed against the recess on the top surface of the clutch plate. At that time, on one hand, the clutch lever 20 disengages from the braking recesses 21 of the ring gear; on the other hand, the clutch gear 12 at the high-speed end doesn't engage the gear segment 2 of the input shaft. Thus the mechanism is in the state of neutral and having no output. That is also an improvement to the original clutch mechanism.

What is claimed is:

1. A variable speed control device of a power winch, said variable speed control device including;

a power-driven input shaft (1) having a gear segment (2);

a transmission seat (5) surrounding the input shaft and supported by a first bearing;

a low-speed transmission mechanism being realized by a low-speed output;

a high-speed transmission mechanism being realized by a high-speed output; and a controller adapted to control the low-speed output and the high-speed output; and wherein the low-speed transmission mechanism is a planetary gear mechanism;

said high-speed transmission mechanism including a shifting gear (16), said shifting gear driven by the controller and connected to a connecting rod (15); a lower end of the connecting rod extending downward and forming an eccentric axis, and the eccentric axis inserted in and connected to a ring groove of a transmission shaft (13); the transmission shaft being mounted coaxially with respect to the input shaft, and the transmission shaft being axially displaceable with respect to the input shaft; a clutch gear (12) mounted on the transmission shaft, and the clutch gear supported by a second bearing (18), the clutch gear having a structure of both internal and external teeth, and the clutch gear engaging the gear segment (2) of the input shaft and engaging internal teeth of the transmission seat (5) to realize the high-speed output; and said controller being a clutch mechanism fastened to a gear box (14), and the low-speed transmission mechanism, the high-speed transmission mechanism, and a neutral state of said variable speed control device being controlled by said clutch mechanism.

2. The variable speed control device of the power winch according to claim 1, wherein said planetary gear mechanism includes a plurality of planetary gears (7) which engage the gear segment (2) of the input shaft, each of the planetary gears (7) is mounted on the transmission seat (5) via a respective planet pin (9), and each of the planetary gears drives the transmission seat to realize said low-speed output, a ring gear (11) surrounds the planetary gears, and the ring gear engages the planetary gears, braking recesses (21) are disposed on an outer circumferential surface of the ring gear, and a clutch lever (20) of the clutch mechanism can be inserted into the braking recesses.

3. The variable speed control device of the power winch according to claim 2, wherein said plurality of planetary gears (7) range from two to four planetary gears, and an equal number of mounting holes (6) are arranged on the transmission seat (5) corresponding to each of said planet pins.

4. The variable speed control device of the power winch according to claim 2, wherein multi-roll bearings (8) are disposed between said planetary gears (7) and said planet pins (9).

5. The variable speed control device of the power winch according to claim 2, wherein the braking recesses (21) range from two to four braking recesses (21).

6. The variable speed control device of the power winch according to claim 1, wherein said connecting rod (15) is positioned in an axle hole of the gear box (14) by a supporting screw or positioning pin (31), and the supporting screw or positioning pin is connected to the gear box and inserted into a ring groove of the connecting rod.

7. The variable speed control device of the power winch according to claim 1, wherein the variable speed control device further includes a bushing on an interface between the transmission seat (5) and the gear box (14), and a gasket (10) on a connection end surface between the transmission seat (5) and the ring gear (11).

8. The variable speed control device of the power winch according to claim 1, wherein retaining rings (17, 19) are disposed at two sides of the second bearing (18) between the transmission shaft (13) and the second bearing and the clutch gear (12) and the second bearing, respectively.

9. The variable speed control device of the power winch according to claim 1, wherein said clutch mechanism includes a clutch plate (27), and the clutch plate has an external gear (25), and said external gear (25) of said clutch plate has a same module and a same number of teeth as said shifting gear (16).

10. The variable speed control device of the power winch according to claim 1, wherein a clutch handle (30) of said clutch mechanism is embedded in a clutch plate (27), said clutch handle is connected to a clutch lever (20) via a pin (29), said pin operably passes through a long-slotted hole (28), and the long-slotted hole is arranged on the clutch plate in a perpendicular direction to the clutch lever.

* * * * *